United States Patent [19]

Mahana et al.

[11] Patent Number: 4,605,219

[45] Date of Patent: Aug. 12, 1986

[54] JUMPERCISER

[76] Inventors: Elliott Mahana; George Spector, both of 233 Broadway, Rm 3615, New York, N.Y. 10007

[21] Appl. No.: 609,823

[22] Filed: May 14, 1984

[51] Int. Cl.[4] ..... A63B 5/20

[52] U.S. Cl. ..... 272/75

[58] Field of Search ..... 272/74, 75, 68; 273/26 E; D21/191–198

[56] References Cited

U.S. PATENT DOCUMENTS

| | | | |
|---|---|---|---|
| 906,303 | 12/1908 | Sapper | 272/75 |
| 932,331 | 8/1909 | Russell et al. | 272/75 |
| 2,723,121 | 11/1955 | Cartwright et al. | 272/75 |
| 4,249,729 | 2/1981 | Gabrielidis | 272/68 |
| 4,489,934 | 12/1984 | Miller | 272/75 |

FOREIGN PATENT DOCUMENTS

| | | | |
|---|---|---|---|
| 553528 | 5/1923 | France | 272/75 |

*Primary Examiner*—Richard J. Apley
*Assistant Examiner*—S. R. Crow

[57] ABSTRACT

A jumperciser rope to be used by a person exercising is provided and consists of an elongated rope that has ends engaging ball bearings within top ends of caps that are threaded onto hollow pipe handles to be gripped by hands of the person exercising so that when the rope is turned the person's arms will extend parallel to the ground.

2 Claims, 6 Drawing Figures

JUMPERCISER

BACKGROUND OF THE INVENTION

The instant invention relates generally to jump or skip ropes and more specifically it relates to a jumperciser rope.

Numerous jump or skip ropes have been provided in prior art that are adapted to be used as exercisers to improve muscle development and body building. While these prior art units may be suitable for the particular purpose to which they address, they would not be suitable for the purposes of the present invention as heretofore described.

SUMMARY OF THE INVENTION

A principle object of the present invention is to provide a jumperciser rope designed so that the handles must be held away from the body with extended arms parallel to the ground.

Another object is to provide a jumperciser rope that has ball bearings within each cap portion of each handle to reduce friction when turning the rope.

An additional object is to provide a jumperciser rope that is designed to have an adjustable rope.

A further object is to provide a jumerciser rope that is simple and easy to use.

A still further object is to provide a jumperciser rope that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
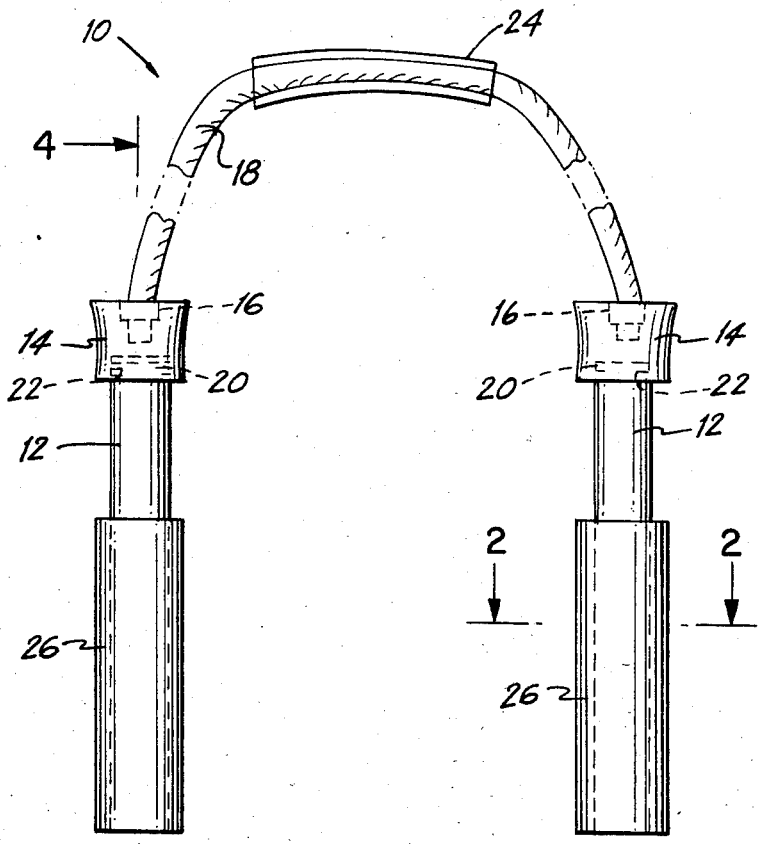
FIG. 1 is a front elevational view of the invention.

Turning now descriptively to the drawings, in which similar reference characters denote similar elements throughout the several views, FIGS. 1 through 4 illustrates a jumperciser rope 10 to be used by a person exercising (not shown). The jumperciser rope 10 consists of a pair of hollow pipe handles 12, 12, a pair of caps 14, 14, a pair of ball bearings 16, 16 and an elongated rope 18.

The pair of handles 12, 12 are to be gripped by hands of the person exercising and each handle 12 has external threads 20 at top end. Each cap 14 has internal threads 22 at bottom end to engage the external threads 20 of one handle 12. Each ball bearing 16 is mounted within top end of cap 14. The rope 18 has each end engaging one ball bearing 16 to reduce friction when the rope is turned with arms extending parallel to the ground when the person is exercising.

Figure 2:
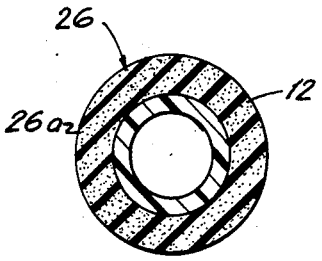
FIG. 2 is a cross sectional view taken along line 2—2 in FIG. 1.
Figure 3:
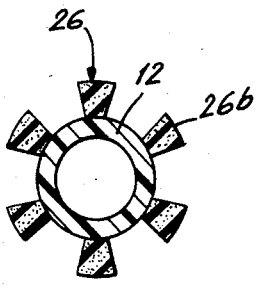
FIG. 3 is a cross sectional view similar to FIG. 2 showing a modified handle.
Figure 4:
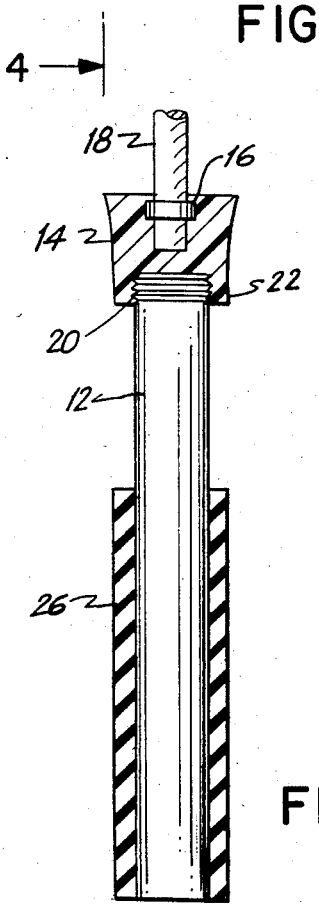
FIG. 4 is a cross sectional view taken along line 4—4 in FIG. 1.

The jumperciser rope 10 further contains a clear transparent sleeve 24 to engage and protect middle portion of the rope 18 when the rope is turned and a pair of foam cushioned hand grip sheaths 26, 26. Each sheath 26 is affixed over one handle 12 to absorb sweat from the hand of the person exercising and absorb shock when the rope 18 is turned. The sheath 26 can be a plain cylinder **26*a* as shown in FIG. 2 or vertically spaced strips 26*b* glued to the handle 12 as shown in FIG. 3**.

Figure 5:
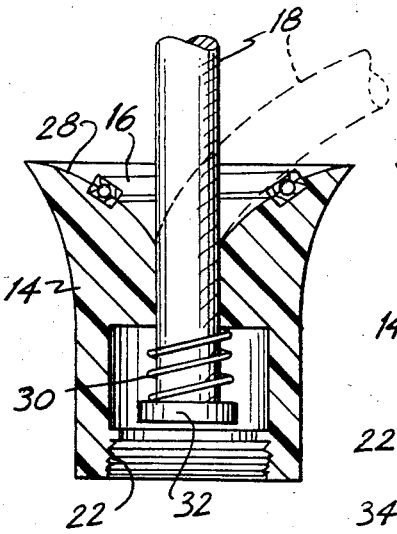
FIG. 5 is an enlarged cross sectional view of a first modification showing a spring loaded rope end in a cap.

FIG. 5 shows a first modification whereby cap 14 has a flared top end 28 so that the end of the rope 18 can slide within the flared top end of the cap. The ball bearing 16 is a race mounted around the flared top end 28 of the cap 14. A compression spring 30 is mounted over the end of the rope 18 within the cap 14. A stop member 32 is affixed to the end of the rope 18 to hold the compression spring 30 against the cap 14. When the rope 18 is turned the compression spring 30 will collapse causing tension on the end of the rope.

Figure 6:
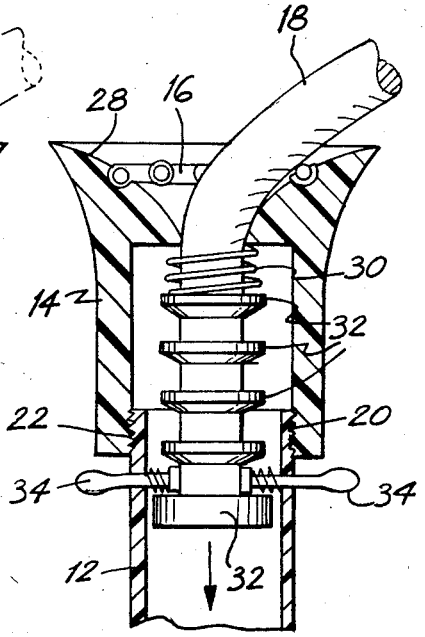
FIG. 6 is an enlarged cross sectional view of a second modification showing an adjustable rope end in a cap and handle.

FIG. 6 shows a second modification. The cap 14 has a flared top end 28 so that the end of the rope 18 can slide within the flared top end of the cap and the hollow pipe handle 12. The ball bearing 16 is also a race mounted around the flared top end 28 of the cap 14. The compression spring 30 is mounted over the end of the rope 18 within the cap 14.

A set of stop members 32 are spaceably affixed to the end of the rope 18 so that when the end of the rope is in its uppermost position the uppermost stop member 32 will hold the compression spring 30 against the cap 14. When the rope 18 is turned the compression spring 30 will collapse causing tension on the end of the rope 18.

Two spring loaded reset pins 34, 34 are mounted transversely to the top end of the hollow pipe handle 12. When the end of the rope 18 is pushed into the cap 14 the reset pins 34, 34 will engage a space between any two stop members 32 thus making the rope 18 adjustable.

The hollow pipe handles 12 and the twisted rope 18 can be fabricated from polypropelyne while the caps 14 can be fabricated from plastic or any other durable material to last over a long period of time.

The jumperciser rope 10 works by holding the handles 12 like any other skip rope. The handle must be held away from the body. The length of the handles help facilitate this method. By turning the rope 18 over head with extended arms and jumping the difference and purpose of the invention is immediately realized. The upper body muscles including hands, wrists, biceps, triceps, chest, stomach, all back muscles in addition to legs and heart muscles are not only exercised but emphasized and massaged. In addition the aerobic workout is much more severe than with an ordinary skip rope. Another major difference is the development of the hand-to-eye-foot coordination which is a method of accelerating this important characteristic.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A jumerciser rope to be used by a person exercising which comprises:

(a) a pair of hollow pipe handles to be gripped by the hands of said person exercising, each said handle having external threads at the top end;

(b) a pair of caps, each said cap having internal threads at the bottom end to engage said external threads of one said handle;

(c) a pair of ball bearings, each said ball bearing mounted within the top end of said cap; and (d) an elongated rope having each end engaging one said ball bearing to reduce friction when said rope is turned with arms extending parallel to the ground when said person is exercising, further comprising:

(a) each said cap having an inner flared top end so that each said end of said rope can slide within one said flared top end of one said cap;

(b) each said ball bearing having a race mounted on each said flared top end;

(c) a pair of compression springs, each said compression spring mounted on each said one end of said rope within said cap; and (d) a pair of stop members each said stop member affixed to said one end of said rope to hold one said compression spring against said cap so that when said rope is turned said compression spring wil compress due to centrifugal force acting on the rotating rope resisted by said stop members acting against the spring which reacts against said spring.

2. A jumerciser rope as recited in claim 1, further comprising:

(a) two sets of additional stop members, each said set of additional stop members longitudinally spaced and each affixed to each said one end of said rope so that when said end of said rope is in its uppermost position said uppermost stop member will hold one said compression spring against one said cap so that when said rope is turned said compression spring will compress due to centrifugal force acting on said rope resisted by said stop and cap acting on said spring, and (b) a pair of spring loaded reset pins, each said reset pin mounted transversely on said top end of each said hollow pipe handle so that when said one end of said rope is pushed into one said cap said reset pin can engage a space between two adjacent spaced stop members thus making said rope adjustable.

* * * * *